US005581965A

United States Patent [19]

Jørgensen et al.

[11] Patent Number: 5,581,965

[45] Date of Patent: Dec. 10, 1996

[54] FLOOR STRUCTURE

[75] Inventors: C. J. Skovbo Jørgensen, Køge; Ole Slott, Vaerløse, both of Denmark

[73] Assignee: Junckers Industrier A/S, Koge, Denmark

[21] Appl. No.: 455,111

[22] Filed: May 31, 1995

[30] Foreign Application Priority Data

May 31, 1994 [DK] Denmark ..... 0609/94

[51] Int. Cl.[6] ..... E04F 15/22

[52] U.S. Cl. ..... 52/403.1; 52/480; 52/506.06; 52/665

[58] Field of Search ..... 52/480, 403.1, 52/506.06, 665, 177

[56] References Cited

U.S. PATENT DOCUMENTS

| | | | |
|---|---|---|---|
| 2,914,815 | 12/1959 | Alexander | 52/177 |
| 4,854,099 | 8/1989 | Kristoffersen | 52/403.1 |
| 5,087,149 | 2/1992 | Waller, Jr. | 52/177 X |

*Primary Examiner*—Christopher T. Kent
*Assistant Examiner*—Timothy B. Kang
*Attorney, Agent, or Firm*—Pollock, Vande Sande & Priddy

[57] ABSTRACT

A floor structure comprises a flooring arranged on top of a lower and an upper layer of parallel joists with a uniform mutual distance, the joists of one layer extending substantially perpendicular to the joists of the second layer. The lower layer of joists are arranged on chocks, at least one of which is located below the center between the upper joists arranged thereabove. Resilient spring elements are provided at the intersections between the two layers of joists. The layers of joists include prefabricated identical members fitting in one another, each member comprising a predetermined number of joists. The joists of the lower layer are equally long and project by half the joist distance of the upper layer of joists beyond the outermost joist at the adjacent end of the upper layer of joists. The joists of the upper layer are also equally long, but interconnected in such a manner that one end of some of the upper joists ends substantially at the center of a spring element on the adjacent outermost joist in the lower layer of joists, such that the corresponding ends of the remaining upper joists project beyond the adjacent outermost joist by a length substantially corresponding to the sum of the joist distance of the lower layer of joists and half the width of a lower joist measured in the longitudinal direction of the upper joist.

6 Claims, 2 Drawing Sheets

FLOOR STRUCTURE

TECHNICAL FIELD

The invention relates to a floor structure comprising a flooring arranged on top of a first lower and a second upper layer of parallel joists, the joists of each layer being uniformly spaced and the joists of one layer extending substantially perpendicular to the joists of the second layer, and further the lower layers of joists being interconnected and arranged on top of chocking means, at least one of the chocking means everywhere being provided substantially below the center between the superposed joists of the upper layer, and resilient spring elements being accommodated at the intersections between the two layers of joists.

BACKGROUND OF THE INVENTION

It is known from DK-PS No, 168,453 to manufacture floor structures with a flooring arranged on top of two layers of parallel joists, whereby the joists of one layer extend perpendicular to the joists of the other layer, and where resilient spring elements arc provided between the two layers of joists at the intersections. The two layers of joists are supported on chocking means. Such a flooring is used, for instance, for the manufacture of sports floors.

SUMMARY OP THE INVENTION

The object of the invention is to provide a floor structure which can be put down in a fast and easy manner.

In the floor structure according to the invention, the two layers of joists are composed of identical prefabricated and mating members. Each member comprises a predetermined number of joists, the joists of the lower layer being equally long and projecting by half the joist distance of the upper layer of joists beyond the outer joist at each adjacent end of the upper layer of joists, and the joists of the upper layer of joists being equally long, but staggered relative to one another, such that one end of some of the upper joists ends substantially at the center of a spring element on the adjacent outer joist in the lower layer of joists, and further such that the corresponding end of the remaining upper joists projects beyond the adjacent outer joist by a length substantially equal to the sum of the joist distance of the lower layer of joists and one-half the width of a lowermost joist, measured in the longitudinal direction of an uppermost joist.

The resulting floor structure is relatively easy to put down, due to the fact that the individual members are easily prefabricated and then put down in situ merely by joining the members with the joists of each layer extending in extension of one another, and without necessitating direct fastening of the members to one another.

According to the invention it is particularly preferred that at least one chocking means below the lower joists has been fastened in advance to the joists of each member, a chocking means also being fastened to the ends of the lower joists of each member.

In order to ensure particularly good resilience in the floor structure, the top side of the joists of the lower layer of joists of each member may be provided with a vertical, transverse slot substantially centrally between each pair of adjacent joists in the upper layer of joists.

Particularly good resilience is obtained when the joists are formed by layers of spruce plywood glued together in parallel.

According to the invention, the spring elements may be solid blocks of a rubber material of rectangular shape as seen from above, as the spring elements are of a width substantially corresponding to half the joist width in the lower layer of joists at all the intersections other than those where the upper joists of each member end, while the remaining robber blocks are substantially twice as wide. In this manner a good, resilient support of all the upper joists is ensured.

Finally according to the invention, the top side of each rubber block may comprise a recess at each end for fastening to the lower joists, and at least each of the narrow rubber blocks may comprise a central through opening allowing passage of a screw during the fastening of the remaining joists on the lower joists, whereby a particularly easy and fast manufacture of the prefabricated members is obtained.

BRIEF DESCRIPTION OF THE DRAWINGS

The invention is explained in greater detail below with reference to the accompanying drawing, in which.

DETAILED DESCRIPTION OF THE PREFERRED EMBODIMENTS

Figure 1:
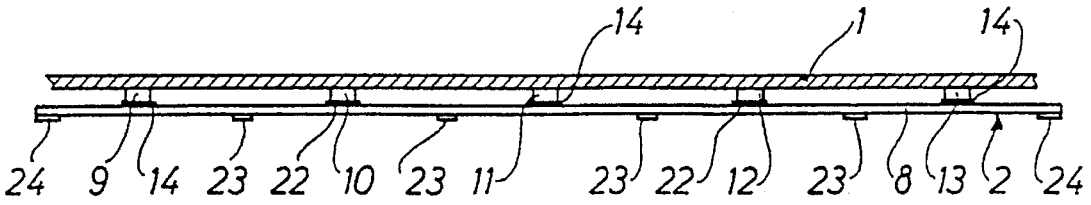
FIG. 1 is a vertical section side view through a floor structure according to the invention, whereby only a single member of joists is shown.

The floor structure shown in PIG. 1 comprises a flooring 1, which is secured in a conventional manner on top of two layers of joists. The layers of joists comprise a plurality of identical joist members 2, only one of which is shown. These joist members are arranged either directly on a sub-floor or spaced from the sub-floor by chocking means know per se and not shown in greater detail.

As illustrated in PIG. 2, a joist member 2 comprises a first lower layer of parallel joists 3, 4, 5, 6, 7 and 8 equispaced at a distance $1_1$. These lower joists 3–8 are of the same length and arranged with ends aligned in such a manner that they jointly cover a surface in the shape of a rectilinear rectangle. A second, upper layer of joists 9, 10, 11, 12 and 13 is placed on top of the lower layer of joists 3–8. These upper joists 9–13 are also parallel and equispaced, at a distance $1_2$, and extend perpendicular to the lower layer of joists 3–8. The outermost joists 9 and 13 of the upper layer are arranged at a distance corresponding to one-half ($1_2/2$) their mutual distance from the respective ends of the lower joists 3–8. All the joists in the lower layer have a width a, and all the joists of the upper layer have a width b. In the illustrated embodiment of the invention, the width a and the width b are identical.

Since the outermost joists 9 and 13 of the upper layer are, as already mentioned, arranged at a distance from the respective ends of the lower joists 3–8 which corresponds to one-half their joist distance, the projecting ends of the lower joists 3–8 have a length $1_2/2$.

The joists of the upper layer are staggered relative to one another such that, with respect to outermost joist 3 of the lower layer, alternate upper joists are positioned immediately above the center of the joist 3 therebelow and projecting beyond that joist by a length corresponding to the sum of the joist distance $1_1$ in the lower layer and one-half the joist width a/2 of the lower joists 3–8.

Figure 2:
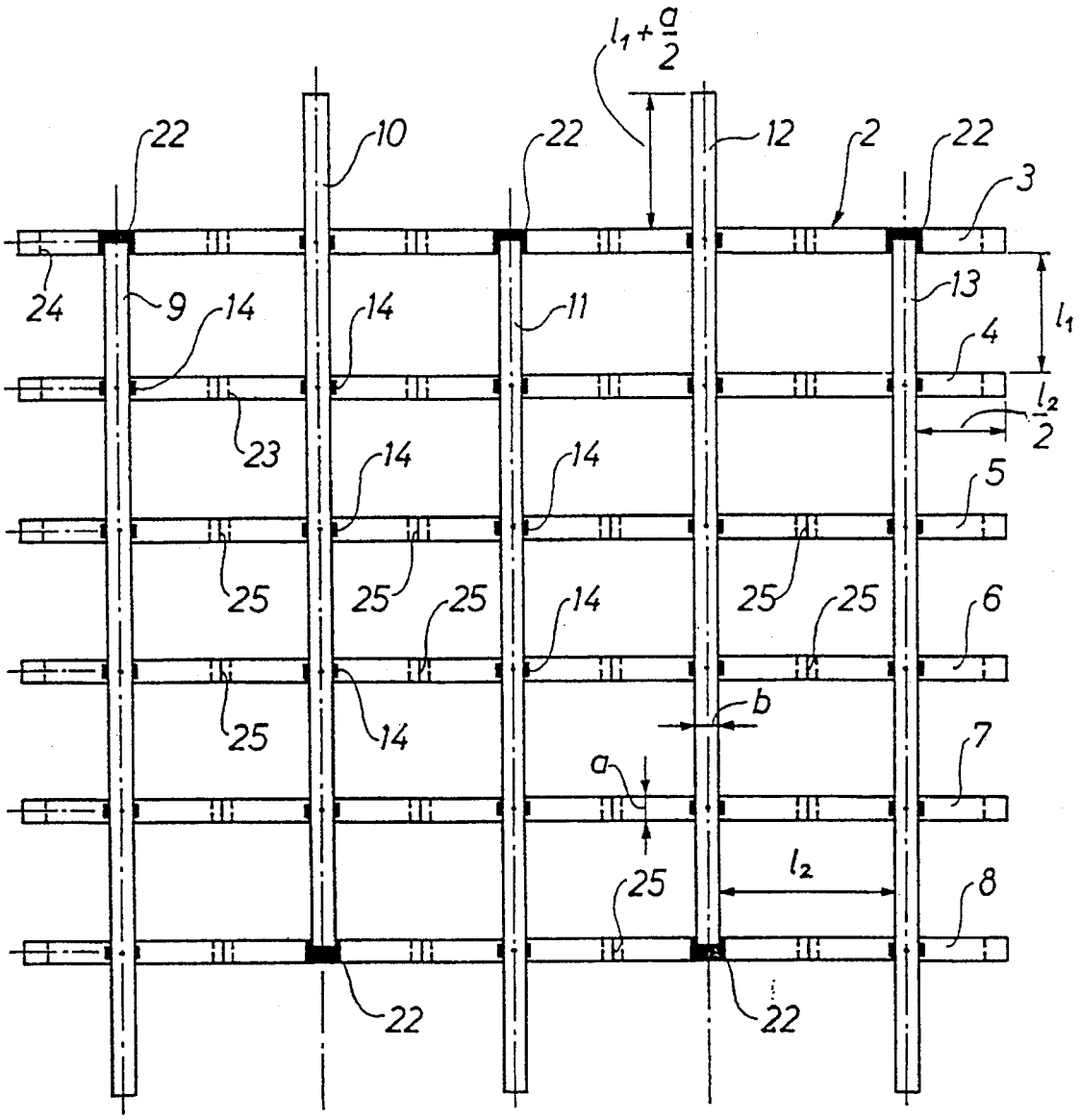
FIG. 2 is a top plan view of a joist member.
Figure 3:
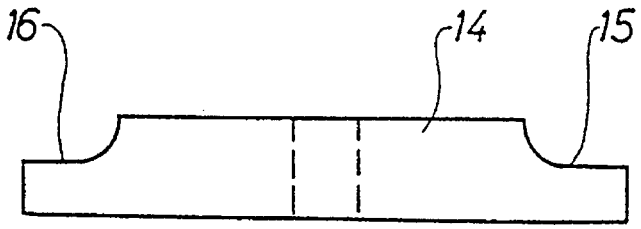
FIG. 3 is a side view of an embodiment of a spring element.
Figure 4:
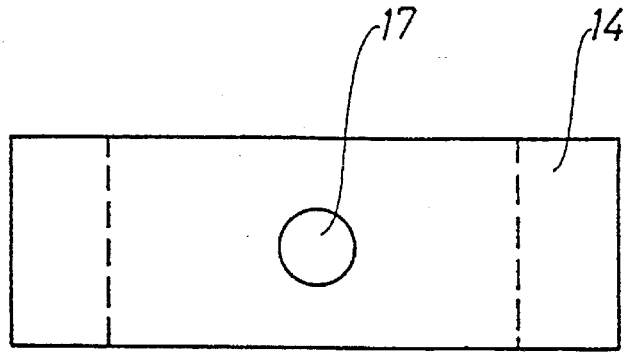
FIG. 4 is a top plan view of the same embodiment.
Figure 5:
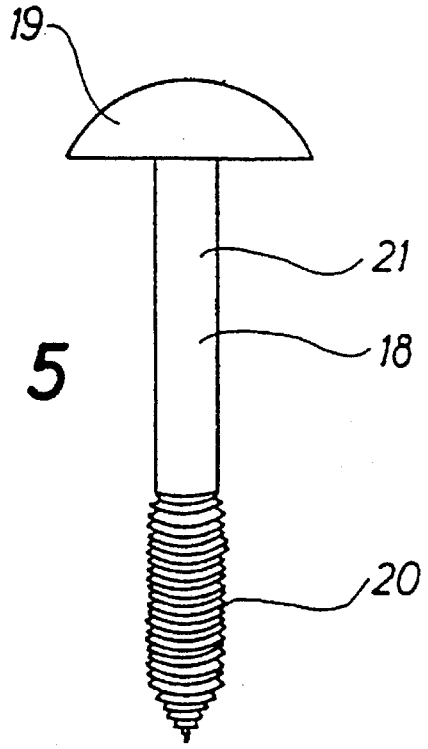
FIG. 5 shows a screw for securing the joists at the intersections.

A spring element 14 of the type shown in FIGS. 3 and 4 is provided at the intersections between all the joists 3–8 and 9–13 except for those where the uppermost joists 9–13 end directly above the outermost lower joists 3 and 8, respectively. These spring elements are indicated in black in FIGS. 1 and 2. They comprise a robber block, which in the preferred embodiment is made of a rubber material sold under the Trade Mark SYLOMER V-grey which has a density of 650 kg/m$^3$. This rubber material is formed as a mat, from which the members shown in FIGS. 3 and 4 are cut out in the desired shape. At the ends a recess 15, 16 brined as a step is provided for fastening the spring members to the lowermost joists 3–8 by means of clamps or other fastening means. A through opening 17 is provided in the center of the spring element, for use during the fastening of the upper joists 9–13 to the lower joists 3–8, e.g., by means of screws 18 of the type shown in FIG. 5.

These screws comprise a head 19 and thread 20 spaced by a smooth intermediary shaft 21. The fastening of the upper joists 9–13 to the lower joists 3–18 involves a drilling of through holes for the screws 18 in the upper joists 9–13. Subsequently, the screws 18 are inserted through these holes (not shown) and the openings 17 in the spring elements 14 and screwed into the lower joists 3–8, the thread 20 being positioned within the area of the lower joists 3–8 after final mounting.

Spring elements 22 are provided at the intersections where the ends of the upper joists 9–13 are positioned centrally on top of one of the outermost joists 3 and 8 in the lower layer of joists 3–8, The spring elements 22 are also indicated in black in FIGS. 1 and 2 and correspond completely to the elements 14 shown in FIGS. 1 and 2 except for the absence of a through hole for the reception of a screw. In addition, they have a width slightly greater than spring elements 14 so as to allow them to mate with the lower joists 3–8.

A chocking means 23 provided everywhere on the bottom side of the lower joists 3–8 centrally between the upper joists 9–13. This chocking means is made of chipboard. material and secured by means of clamps. Corresponding chocking means 24 are fastened at the ends of the lower joists 3–8. The chocking means 24 are here rather long in the longitudinal direction of the joist 3–8 in question.

A transverse slot 25 is shaped everywhere at the center between the upper joists 9–13 and directly above the chocking means 23. This slot extends downward from the top side of the lower joists 3–8. The latter applies to all joists of a coefficient of rigidity E×1 in the range of $250\times10^6$ to $1200\times10^6$ Nmm$^2$, where E is the modulus of elasticity and 1 is the moment of inertia.

In use, the joist members 2 are arranged so as to abut one another in such a manner that the lower layers of joist 3–8 extend in extension of one another, and such that the upper layers of joist 9–13 also extend in extension of one another. As a result, the projecting ends of the ulcer joists 9–13 rest on top of the spring elements 22 of the adjacent members, and the projecting ends of the abutting joist members are arranged on top of the spring elements 22 on the joist member 2 shown. The joist members are retained in position without further fastening to one another by being completely adjusted along the sides of the area on which the floor is to be put down. It may be necessary to cut off parts of the joist members 2.

According to a preferred embodiment, the lower joists are of a length of 2,055.5 mm, while the upper joists are of a length of 1,800 mm. The number of lower joists is six while the number of upper joists is five. All the joists have a cross section With a width of 51 mm and a height of 21 mm. The joists are made of spruce plywood glued in parallel and including seven layers of thickness of 3 mm each. The joists are manufactured by cutting out prefabricated plates in the desired dimensions. The number and dimensions of the joists in each layer can obviously vary.

The spring elements 14 have a width of 25 mm, a length of 76 mm and a height of 12 mm. The remaining spring elements 22 are of the same length and height, but of a width of 51 mm which corresponds to the width of the joists. The slots 25 in the lower joists 3–8 have a depth of 12 mm. The chocking means 23 in the area between the upper joists 9–13 have dimensions of 9×35×51 mm, whereas the chocking means provided at the ends have dimensions of 9×51×51 mm. By placing a flooring of boards of beech of the dimensions 22×129 mm on top of such means and nailing them to the joist members, it is possible to manufacture a floor structure meeting the required DIN-standard 18032, dell 11. for sports floors.

We claim:

1. A floor structure comprising a flooring arranged on top of a lower layer and an upper layer of parallel joists, the joists of each layer being uniformly spaced and the joists of said lower layer extending substantially perpendicular to the joists of said upper layer, the joists of said lower layer being interconnected and arranged on top of chocking means, at least one of said chocking means being provided substantially below a center between superposed joists of said upper layer, and resilient spring elements being disposed at intersections between said lower and upper layers of joists, wherein (a) said lower and upper layers of joists are composed of prefabricated identical mating members;

(b) each member comprises a predetermined number of joists;

(c) the joists of said lower layer are of equal length and project by one-half the joist distance of said upper layer of joists beyond an outermost joist at each adjacent end of said upper layer of joists;

(d) the joists of said upper layer of joists are of equal length, but staggered relative to one another, such that one end of some of the upper joists ends substantially at the center of a spring element on an adjacent outer joist in the lower layer of joists; and (e) a corresponding end of the remaining upper joists projects beyond an adjacent outer joist by a length substantially equal to a sum of the joist distance of the lower layer of joists and one-half the width of a lowermost joist, measured in a longitudinal direction of an uppermost joist.

2. The floor structure according to claim 1, wherein said at least one chocking means below the lower joists is pre-fastened to the joists of each joist member, and a chocking means is also fastened at the ends of the joists in the lower layer of each mating member.

3. The floor structure according to claim 1, wherein a vertical transverse slot is provided on a top side of the joists in the lower layer of joists of each mating member, said slot being located substantially centrally between each pair of adjacent joists in the upper layer of joists.

4. The floor structure according to claim 1, wherein the joists are made of layers of spruce plywood glued together in parallel.

5. The floor structure according to claim 1, wherein the spring elements are solid blocks of a rubber material of a rectangular shape when seen from above, and have a width substantially corresponding to one-half the width of a joist in the lower layer of joists at all intersections except for the intersections where the upper joists of each mating member end, while remaining blocks have a width substantially twice as great.

6. The floor structure according claim 5, wherein a top side of each block comprises a recess at each end for fastening to the lower joists, and wherein at least each of said solid rubber blocks comprises a central through opening allowing passage of a screw during the fastening of the uppermost joists to the lowermost joists.

* * * * *